US005373642A

United States Patent [19]

Supe-Dienes

[11] Patent Number: 5,373,642

[45] Date of Patent: Dec. 20, 1994

[54] KNIFE HOLDER WITH QUICK-CLAMPING DEVICE

[75] Inventor: Rudolf Supe-Dienes, Overath, Germany

[73] Assignee: Dienes Werke für Maschinenteile GmbH & Co. KG, Overath-Vilkerath, Germany

[21] Appl. No.: 855,744

[22] Filed: Mar. 23, 1992

[30] Foreign Application Priority Data

Mar. 23, 1991 [DE] Germany ..... 9103603.8[U]

[51] Int. Cl.[5] ..... B26D 7/26

[52] U.S. Cl. ..... 30/296.4; 269/82; 269/228

[58] Field of Search ..... 30/296.1; 74/519; 254/15, 17, 243, 246; 83/504, 507, 508, 508.2; 269/82, 228

[56] References Cited

U.S. PATENT DOCUMENTS

| | | | |
|---|---|---|---|
| 1,781,833 | 11/1930 | Cummer | 254/17 |
| 2,705,125 | 3/1955 | Weise | 254/246 |
| 2,753,631 | 7/1956 | Culver | 30/296.1 |
| 3,199,838 | 8/1965 | Gillen | 254/243 |
| 3,613,283 | 10/1971 | Mozey, Jr. | 30/296.1 |
| 4,054,994 | 10/1977 | Grossman | 30/296.1 |
| 4,213,241 | 7/1980 | Haapala | 30/296.1 |

FOREIGN PATENT DOCUMENTS 2340804 2/1975 Germany .

*Primary Examiner*—Richard K. Seidel
*Attorney, Agent, or Firm*—Robert W. Becker & Associates

[57] ABSTRACT

A cutting apparatus is comprised of a transverse beam, a plurality of knife holders that are slidably connected to the transverse beam, a counter roller against which the knife holders are pressed for a cutting action, and a clamping device for fastening the knife holders to the transverse beam. Each knife holder comprises a housing and at least one knife, whereby the housing has a projection and a support on one side for receiving the transverse beam therebetween. The clamping device is comprised of an actuating lever, a connecting part, and a movable clamping member whereby the actuating lever is connected to the securing member by the connecting part for actuating the securing member and fastening the knife holder at the transverse beam. The securing member may be a bolt which is axially slidable within a bore of the projection of the housing, and the actuating lever is preferably pivotably supported at the projection.

4 Claims, 2 Drawing Sheets

KNIFE HOLDER WITH QUICK-CLAMPING DEVICE

BACKGROUND OF THE INVENTION

The present invention relates to a cutting apparatus having a transverse beam for supporting knife holders and with which the individual knives may be pressed against a counter roller. The knife holders are slidably connected to the transverse beam and in the cutting position connected to the transverse beam by a clamping device cooperating with a support provided at the housing of the knife holder and comprising a movable securing member.

A cutting apparatus of the aforementioned kind is known from German Patent 23 40 804 in which individual knife holders are described as components of a cutting apparatus. As is common in the prior art, each individual knife holder is placed onto the transverse beam of the cutting apparatus and is fastened with a clamping device in its respective cutting position. The clamping device is comprised of a support provided at the housing of the knife holder which contacts a corresponding part of the transverse beam and a respective movable securing member which in cooperation with the support provides the fixation of the housing of the knife holder at the transverse beam. The movable securing member is actuated by a screw and pressed, respectively, clamped against the transverse beam.

This known knife holder has the disadvantage that the adjustment and fastening of the knife holder is complicated and is furthermore inaccurate with respect to positioning. For example, when the operator tightens the screw for clamping the movable knife holder, the operator, with his other hand, must correctly position the movable knife holder relative to the transverse beam in order to prevent lateral displacement of the knife holder while tightening the screw. Due to the tightening movement and the engaging screw, a lateral force component acts on the housing of the knife holder which, in addition, may cause the knife holder to change its previously adjusted position during the tightening step so that a change of the cutting width between individual knife holders will result.

It is therefore an object of the present invention to provide a cutting apparatus of the aforementioned kind in which the fastening of the knife holders at the transverse beam is improved such that the knife holder may be positioned with the desired accuracy in a fast and reliable manner.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
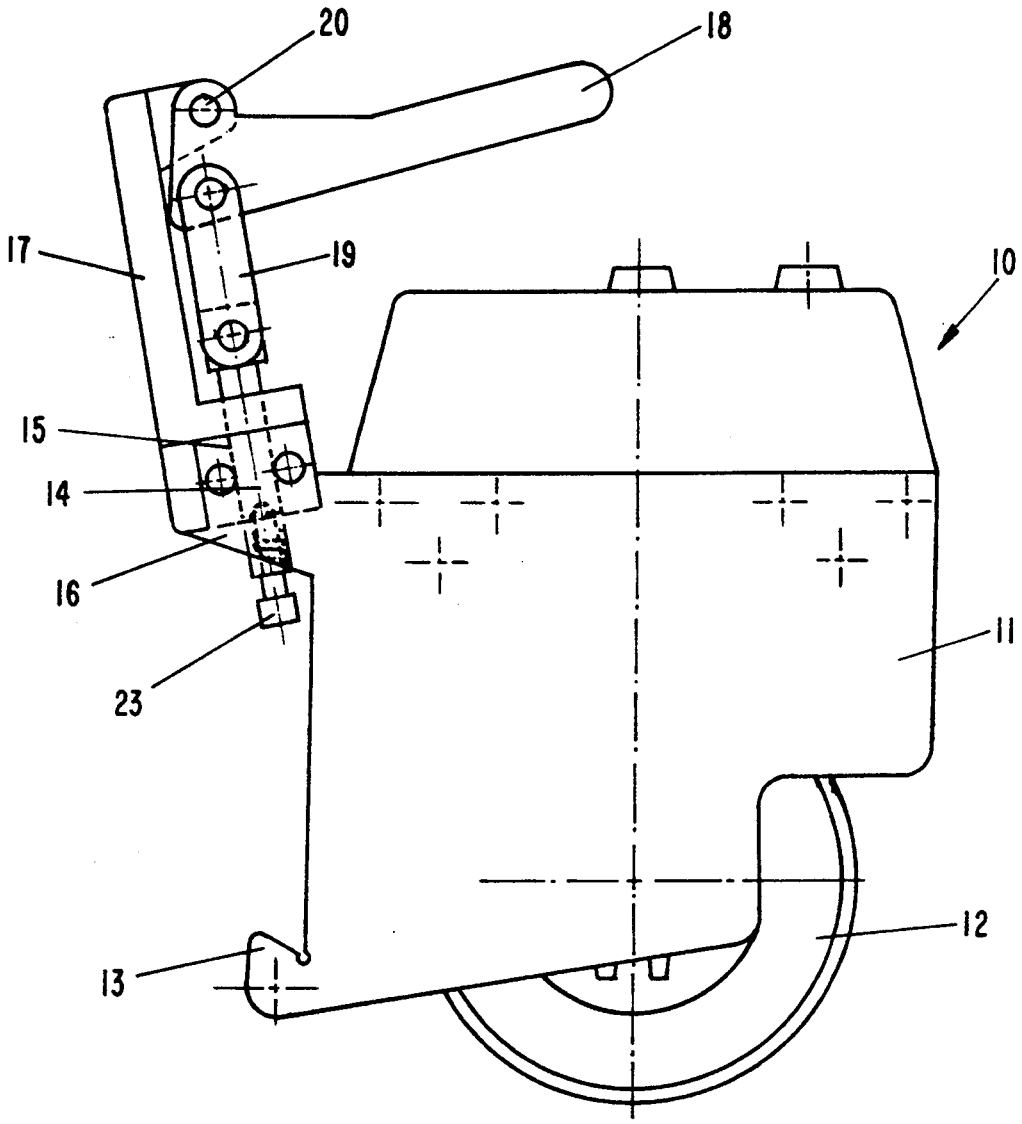
FIG. 1 shows a knife holder in a side view.

The cutting apparatus of the present invention is primarily characterized by a transverse beam; a plurality of knife holders slidably connected to the transverse beam, each knife holder comprising a housing and at least one knife, the housing having a projection and a support on one side of the housing for receiving the transverse beam therebetween; a counter roller against which the knife holders are pressed for a cutting action; and a clamping device comprising an actuating lever, a connecting part, and a movable securing member, the actuating lever being connected to the securing member by the connecting part for actuating the clamping member.

The projection has preferably a bore and the securing member is a bolt which is axially slidable within the bore, whereby the actuating lever is pivotably supported at the projection. Preferably, the connecting part is an eccentric drive. It is advantageous that the actuating lever is movable transverse to a longitudinal axis of the transverse beam.

The cutting apparatus advantageously further comprises a clamping spring connected to the projection and extending with one end beyond the securing member toward the support, whereby the clamping spring is stressed when the transverse beam is received between the projection and the support. It is further preferable that a cup spring connected to a free end of the securing member is provided, whereby the cup spring is positioned between the free end of the clamping member and the end of the clamping spring.

The inventive improvement provides essentially that the knife holder is provided with a connecting part which is actuated by the actuating lever for actuating the movable clamping member. This is advantageous because, due to the actuation of the connecting part, the operating personnel may fasten the knife holder in a single operating step, without additional fastening measures, at the transverse beam so that, as a result, not only a simpler handling of the knife holder during its positioning, but also a more accurate positioning of the knife holder at the transverse beam is accomplished.

In a first embodiment of the present invention, the movable securing member is in the form of an axially slidable bolt inserted into the projection of the housing which is actuated by a pivotably supported actuating lever. For this purpose, the actuating lever is connected to the bolt by an eccentric drive such that the pivoting movement of the actuating lever is transformed into a linear movement of the movable bolt and is thus transformed into the clamping or securing of the knife holder at the transverse beam.

According to the present invention, the actuating lever is advantageously pivotable transverse to the longitudinal axis of the transverse beam so that in this manner it is ensured that during the actuation of the actuating lever a lateral displacement of the knife holder at the transverse beam will not occur.

In another preferred embodiment of the present invention, it is provided that a clamping spring is connected to the projection and extends with one end beyond the clamping member toward the support. The clamping spring is stressed when the transverse beam is received between the projection and the support. This is especially advantageous because the knife holder may be clamped onto the transverse beam, when the clamping device is in its released state, and is maintained in this position due to the stressed clamping spring without the clamping device being actuated. With this particular embodiment, especially a plurality of knife holders may be positioned at the transverse beam according to their respective required adjustment positions in a simple and fast manner so that the clamping device for fastening the knife holders in their specific position must be activated only after their exact positioning at the transverse beam.

In order to provide a compensation for manufacturing tolerances etc., it is advantageous to provide a cup spring at the end of the securing member, respectively, the bolt which is positioned essentially between the clamping spring and the respective end of the securing member or bolt. In this manner, the securing member or bolt, respectively its free end, acts via the intermediate cup spring in a clamping manner an the transverse beam.

DESCRIPTION OF PREFERRED EMBODIMENTS

The present invention will now be described in detail with the aid of several specific embodiments utilizing FIGS. 1 and 2.

A knife holder 10 having a housing 11 is further provided with a device for lowering a circular knife 12 which is disposed within the housing and not shown in the drawings. The housing 11 is further provided with a clamping device for fastening the housing 11 of the knife holder 10 to a transverse beam (not represented) of a cutting apparatus.

The housing 11 thus further comprises a lower support 13 in the vicinity of the cutting knife 12 which is shaped according to the contour of the transverse beam in order to provide a form-locking contact. At the upper end of the housing 11, opposite the support 13, a bolt 14 with a bolt head 23 screwed thereto is provided as the movable securing member which is arranged in a axially slidable manner in a bore 15 of a projection 16 of the housing 11. The longitudinal axis of the bolt 14, respectively, the bore 15 is slanted relative to the vertical axis of the knife holder and extends in the locking direction toward the vertical axis so that the bolt 14 in cooperation with the support 13 connected fixedly to the housing 11 will come into a clamping contact with the transverse beam (not represented).

The projection 16 of the housing 11 is further provided with a holder 17 for an actuating lever 18 which is pivotable transverse to the longitudinal axis of the transverse beam. The pivoting axis 20 of the actuating lever 18 is arranged eccentric to the longitudinal axis of the bolt 14, respectively, bore 15. Between the bolt 14 and the actuating lever 18 a connecting part 19 in the form of an eccentric drive is provided which is movably connected to the aforementioned parts 14 and 18 so that a transformation of the pivoting movement of the actuating lever 18 into a linear movement of the bolt 14 is accomplished. The arrangement of the parts is preferably selected such that, in the locking position of the actuating lever 18, the connecting part 19 is aligned with the longitudinal axis of bolt 14 so that the forces transmitted via the actuating lever 18 onto the bolt 14 may result in a clamping engagement of the transverse beam against the support 13 of the housing 11.

The drawing shows the knife holder (without representing the transverse beam) in a fixed cutting position in which the actuating lever 18 is in its clamping position. In order to release the clamping device and to remove the knife holder 10 from the transverse beam, the actuating lever 18 is pivoted in an upward direction whereby the connecting part 19 is released from its stretched position and moves the bolt 14 within the bore 15 upwardly so that enough play is provided for removing the knife holder 10 from the transverse beam. When it is desired to position the knife holder 10 on the transverse beam, the support 13 of the housing 11 is placed against the transverse beam and the actuating lever 18 is then moved into the position shown in the drawing in which via the connecting part 19 the bolt 14 with its bolt head 23 is pressed against the transverse beam and, in the final position of the actuating lever 18, a clamping fixation of the knife holder 10 at the transverse beam is accomplished.

Figure 2:
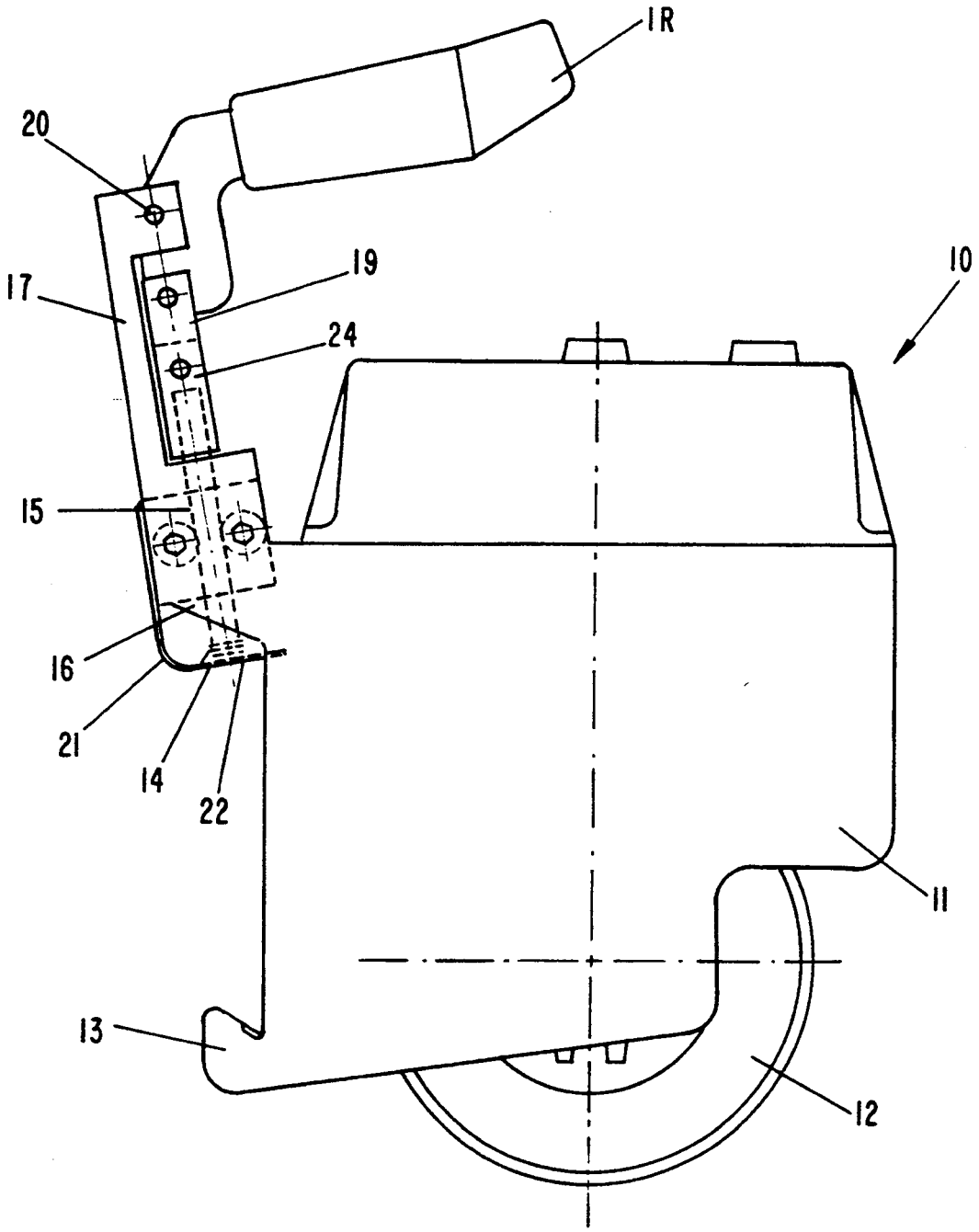
FIG. 2 shows a different embodiment of the knife holder of FIG. 1.

As can be seen in FIG. 2 it is advantageous to provide a C-shaped leg spring as a clamping spring 21 which, with the upper leg of the "C", is connected to the projection 16 and with the lower leg of the "C" extends past the bolt 14 so that it projects into the free space provided for receiving the transverse beam within the knife holder 10. In the clamping position of the clamping device (FIG. 2), the clamping spring 21 is stressed by the transverse beam, not represented in the drawings, and thus supports the clamping action of the bolt 14. The spring force of the clamping spring 21 is selected such that, when the clamping device is released, the lower leg of the "C" of the clamping spring 21 is stressed by positioning the knife holder 10 on the transverse beam such that the knife holder 10, due to the spring force of the clamping spring 21, is fastened to the transverse beam without actuating the clamping device. In order to provide a means for compensating manufacturing tolerances etc. the head of the bolt 14 is additionally provided with a cup spring 22 arranged between the head of the bolt and the clamping spring 21 so that the bolt 14 acts via the cup spring 22 onto the transverse beam. In this manner, canting between the bolt 14 and the transverse beam which may be caused by manufacturing tolerances may be prevented.

In the embodiment shown in FIG. 2, the bolt 14 is screwed into a securing element 24 which is pivotably connected to the connecting part 19 so that a pivoting of the actuating lever 18 from the locking position (shown in FIG. 2) results in a bending of the parts 19, 24 so that the bolt 14 is linearly moved within the bore 15.

The features of the inventive apparatus disclosed in the above specification, the claims and the drawings may be important for the realization of the present invention in its various embodiments individually or in any desired combination.

The present invention is, of course, in no way restricted to the specific disclosure of the specification and drawings, but also encompasses any modifications within the scope of the appended claims.

What is claimed is:

1. A cutting apparatus comprising:

a transverse beam;

a plurality of knife holders slidably connected to said transverse beam, each said knife holder comprising a housing and at least one knife, said housing having a projection and a support on one side of said housing for receiving said transverse beam therebetween;

a counter roller against which said knife holders are pressed for a cutting action;

a clamping device comprising an actuating lever, a connecting part, and a movable securing member, said actuating lever being connected to said securing member by said connecting part for actuating said securing member;

said projection having a bore and said securing member being a bolt which is axially slidable within said bore, with said actuating lever being pivotally supported at said projection; and said connecting part being an eccentric drive.

2. A cutting apparatus according to claim 1, wherein said actuating lever is movable transverse to a longitudinal axis of said transverse beam.

3. A cutting apparatus according to claim 1, further comprising a clamping spring connected to said projection and extending with one end beyond said securing member toward said support, said clamping spring being stressed when said transverse beam is received between said projection and said support.

4. A cutting apparatus according to claim 3, further comprising a cup spring connected to a free end of said securing member, said cup spring being positioned between said free end of said securing member and said end of said clamping spring.

* * * * *